United States Patent [19]

Koide et al.

[11] Patent Number: 4,620,583

[45] Date of Patent: Nov. 4, 1986

[54] LOOP TYPE CONTINUOUS METAL CASTING MACHINE

[75] Inventors: Masakazu Koide; Takashi Okazaki, both of Ibaragi; Takashi Asari, Osaka, all of Japan

[73] Assignees: Sumitomo Metal Industries, Ltd., Osaka; Sumitomo Heavy Industries, Ltd., Tokyo, both of Japan

[21] Appl. No.: 706,321

[22] Filed: Feb. 27, 1985

[30] Foreign Application Priority Data

Feb. 28, 1984 [JP] Japan ..... 59-36917
Oct. 31, 1984 [JP] Japan ..... 59-230691

[51] Int. Cl.[4] ..... B22D 11/16; B22D 11/06

[52] U.S. Cl. ..... 164/154; 164/430; 164/431

[58] Field of Search ..... 164/4.1, 150, 154, 427, 164/429–432, 451, 452, 479, 481

[56] References Cited

U.S. PATENT DOCUMENTS 3,860,057 1/1975 Garlick ..... 164/431
3,865,176 2/1975 Dompas et al. ..... 164/481
4,150,711 4/1979 Hazelett et al. ..... 164/481

FOREIGN PATENT DOCUMENTS 2086281 2/1982 United Kingdom ..... 164/432

*Primary Examiner*—Nicholas P. Godici
*Assistant Examiner*—Richard K. Seidel
*Attorney, Agent, or Firm*—Burns, Doane, Swecker & Mathis

[57] ABSTRACT

Herein disclosed is a loop type continuous metal casting machine in which two side dams are revolved in a loop passing along a casting zone from the entrance end thereof between upper and lower endless revolving casting belts to define a downhill moving mold and in which each of the side dams is formed of a multiplicity of metal dam blocks so strung onto a flexible metal strap loop that the metal dam blocks abut in end-to-end relationship against one another but are allowed to slide on and relative to the metal strap loop. Push means is disposed near the entrance end of the casting zone and is reciprocated back and forth in synchronism with the passage of each side dam for periodically entering the wedge-shaped gap, which is formed between the adjacent two of the metal damblocks of the corresponding side dam loop before entry into the casting zone, to push the preceding one of the adjacent two forward thereby to tightly press the preceding damblocks together so that the end-to-end abutting relationships of the damblocks may be ensured while the side dam loops are passing through the casting zone. Thus, molten metal can be continuously cast in the moving mold without burrs.

17 Claims, 15 Drawing Figures

LOOP TYPE CONTINUOUS METAL CASTING MACHINE

BACKGROUND OF THE INVENTION

1. Field of the Invention

The present invention relates to a loop type continuous metal casting machine and, more particularly, to a twin-belt casting machine of the above type, in which two side dams are revolved in a loop passing along a casting zone from the entrance end thereof between upper and lower revolving casting belts to define a downhill moving mold and in which each of the side dams is formed of a multiplicity of metal dam blocks so strung onto a flexible metal strap (or wire) loop that the metal dam blocks abut in end-to-end relationship against one another but are allowed to slide on and relative to the metal strap (or wire) loop.

2. Description of the Prior Art

In such casting machines, the two side surfaces of the mold region are defined by a pair of spaced side dams which are divided into two types: the stationary and moving types. In order to eliminate a variety of bad influences which are caused by the endothermic actions and thermal deformation of the side dams while the cast metal is being solidified and extracted, the stationary or fixed dam type casting machines have to adopt a water-cooling apparatus and to take countermeasures for preventing any possible sticking of cast metal on the dam surface so that their constructions become complicated. Since the cast metal slides on the surfaces of the fixed side dams, moreover, these side dams tend to wear off. From the standpoint of quality, on the other hand, the side surfaces of the cast metal are degraded as a result of the sticking, and the degraded side surfaces are doubled to raise defects during a subsequent rolling operation because the molten metal will steal into those gaps between the side surfaces of the metal and the side surfaces of the side dams, which are formed as a result of the solodification and shrinkage. These defects on side surfaces of the cast metal have to be cured at a subsequent step added. From the reasonings made above, the fixed dam type casting machines are not used at present for longtime casting operations.

It is the moving dam type casting machines that are devised to solve the aforementioned problems of the fixed dams type casting machines. Therefore, the moving dam type casting machines are currently used for the long casting operations.

These moving dam type casting machines are exemplified by a twin-belt casting machine which will be described with reference to FIGS. 1 to 6. This casting machine, which is generally indicated at numeral 10, is constructed to include upper and lower endless casting belts 11 and 12 which are spaced from each other and which are revolved by two pairs of rolls 13 and 14, respectively. A moving mold has its upper and lower surfaces defined by the paired casting belts 11 and 12. The two side surfaces of the moving mold are defined by a pair of two side dams 15, each of which is composed of a multiplicity of metal damblocks 16. The side dams 15 are revolved in the form of a loop, which passes along a casting zone a from the entrance end thereof, between the revolving casting belts 11 and 12 by the lower belt 12 to define a downhill moving mold between the side dams 15. The side dam loop returns from the exit end to the entrance end of the casting zone a along a path b which is located away from the casting zone a. The metal damblocks 16 are slotted therethrough so that they can be strung onto each of two flexible metal strap loops 17, as better seen from FIG. 2. As a result, a pair of side dam loops are formed, in which the metal damblocks 16 abut in end-to-end relationship against one another but are allowed to slide on and relative to the metal strap loops 17.

Here, the side dam loops are ordinarily moved not by a special driving apparatus but by the structure in which they are driven by the frictional forces generated as a result of their contacts with the lower casting belt 12 when the upper and lower belts 11 and 12 are revolved by the rolls 13 and 14. During the travel, the side dams 15 are heated by the cast metal being cast so that their temperature gradually rises. Turning to FIG. 3, therefore, there is disposed below the lower casting belt 12, i.e., downstream of the exit end of the casting zone a a cooling apparatus 18 which prevents the temperature of the traveling side dams 15 from rising over a predetermined level.

In FIGS. 3, 4 and 5: reference numeral 19 indicates a dam side guide; numeral 21 a plurality of entrance end guide rollers; and numerals 22 and 23 front and rear flanged rollers, all of which are used, as customary, to guide and regulate together the moving side dams 15.

The moving dams type continuous metal casting machine of the prior art has the following problem:

A first problem, i.e., the problem intrinsic to the moving side dams 15 is that, since each side dam 15 is given an allowance for thermal expansion about one thousandth as large as its total loop length, the gaps are either accumulated to as large as 5 to 10 mm so as to prevent the steel strap loops 17 from being broken, in case the allowance is concentrated at one portion, or are scattered at several portions. This will be described in more detail in the following. Gaps are formed in advance between the damblocks 16 because the steel strap loops 17 and the damblocks 16 strung thereon exert different expansions. In the ordinary run, as better seen from FIG. 1, those gaps have a tendency to concentrate at or around a gap zone c which is located downstream of the exit end of the casting zone a, i.e., downstream of the righthand lower roll 14. As the slippages between the respective damblocks 16 and the steel strap loops 17 grow worse, however, the gaps are frequently formed even in the casting zone a. Then, the molten metal in the moving mold leaks into the gaps between the damblocks 16 in the casting zone a to produce irregular sides or burrs on the cast product. Another but more serious problem is that the molten metal flows out to invite dangers, if the stealing rate of the molten metal is so high that the molten metal damages and breaks the exposed portion or portions of the steel strap loops 17. And, if the molten metal steals into the gaps and solidifies therein, moreover, the cast product is pulled and broken at the exit end of the casting machine by the damblocks 16 to make the casting operation impossible. In order to avoid this problem, therefore, it is the solution according to the prior art that the damblocks at the entrance end of the casting machine are manually pushed until the gaps disappear due to thermal expansion. However, this solution raises another problem in safety.

In order to eliminate these difficulties, as shown in FIGS. 2 and 6, the steel strap loop 17 is positioned toward the interior of the side dam loop with respect to the longitudinal centerline of each damblock, and a tensioning apparatus 24 is located at the return side of the side dam loop to push and deflect upward a portion of the depending side dam loop thereby to eliminate the slackness among the damblocks 16 in the casting zone a through a downstream zone d and d' which extends from the exit to the entrance end of the casting zone a, as better seen from FIG. 6 (as should be referred to Japanese Patent Publication No. 58-23181). Despite of this fact, however, the total amount of the compensational gaps $g_1, g_2, \ldots, g_5$ in zone e given by that tensioning apparatus 24 is so limitative that the initial gaps formed during the thermal expansions cannot be absorbed sufficiently. Even if this absorption can be achieved, it is quite difficult to adjust the deflections at all times during the actual operation in accordance with the amount of thermal expansions.

Therefore, it can be said that there is no effective means for preventing the excessively large gaps formed between the damblocks from being accumulated in the casting zone. Thus, it is the current practice to push the damblocks one by one by the operator's hands. This manual practice invites a serious danger in handling the hot molten metal and degrades the rate of operation.

A second problem is concerned with the drive of the moving side dams 15. Because of shortage of any driving apparatus for damblocks themselves, as has been touched hereinbefore, each side dam 15 may be halted to behave as the fixed one even if it is slightly dragged by its loop. This makes it necessary to eliminate causes for the frictional resistances as much as possible between the moving side dam 15 and a guide liner 25 which lines the inner side of each dam side guide 19, as seen from FIG. 5. For this necessity, it is a current practice to apply the Si-oil or a graphite coating as the anti-seizure agent to the guide liner 25 or to increase the hardness of the liner material.

In case the molten metal is to be cast, the cast slab may be caused to meander by the irregular cooling or by the inward deflection of the side dam 15 while it is being solidified and shrunk in the moving mold. In case a transverse pushing force f is exerted upon the moving side dam 15, as shown in FIG. 5, this side dam 15 tends to be forced onto the guide liner 25 of the dam side guide 19 so that either the guide liner 25 or the moving side dam 15 is scratched. If these scratches gradually grow, moreover, the moving side dam 15 may be halted or may be wedged between the guide liner 25 and the metal being cast to bite the side surface of the cast slab. At the same time, the steel strap loop 17 may be accidentally broken so that the casting operation has to be interrupted at last.

In order to eliminate these difficulties, there have been devised: a method of increasing the frictional resistance between the upper and lower casting belts 11 and 12 and the moving side dams 15 as high as possible; a method of either knurling or shot blasting the outer surface of the lower casting belt 12 or knurling the bottom surfaces of the side dams 15 so that they may come into much friction; and a method of increasing the hardness or lubrication of the contacting sides of the side dams 15 with the guide liners 25. However, none of the above-enumerated methods have succeeded in satisfying the intended purposes. Since the side dams 15 are driven by the friction force between the lower casting belt 12 and the side dams 15 themselves, on the other hand, it is conceivable to hold and move the side dams 15 by both the upper and lower casting belts 11 and 12. However, these belts 11 and 12 are heated to expand by the molten metal being gradually cast to solidify so that they are dented or scratched to have their lives shortened.

Another method of smoothening the travel of each side dam 15 is to enlarge the net weight of the side dam 15 thereby to increase the frictional force which is applied to the side dam 15 from the lower casting belt 12. However, this method is practically impossible because of the restrictions on the actual works such as the handling works of mounting or demounting the heavy side dam 15.

It is, therefore, necessary to make the best use of the effective weight of the side dam 15. In the prior art, however, the weight of the side dam 15 is borne, as better seen from FIG. 4, by the front and rear flanged rollers 22 and 23 which are borne in horizontal positions on the front and rear portions of the cooling apparatus 18, as shown in FIG. 3. This positioning makes it impossible to effectively use the weight of the side dam 15. This is because the weight of the side dam 15 in the casting operation is borne by the front and rear rollers 22 and 23 in accordance with the prior art, as shown in FIG. 4.

On the other hand, the method, as disclosed in Japanese Patent Publication No. 58-23181, is acceptable for eliminating the gaps of the moving damblocks 16. However, this method will cause obstructions to the travels of the side dam loops.

SUMMARY OF THE INVENTION

It is, therefore, a major object of the present invention to provide a loop type continuous metal casting machine which is free from all the problems concomitant with the prior art.

Another object of the present invention is to provide a twin-belt casting machine in which damblocks on each side dam are pushed forward, before they enter a moving mold, and are tightly pressed together so they may abut in endto-end relationship against one another without leaving any gap in a casting zone.

Still another object of the present invention is to provide a twin-belt casting machine in which each side dam is guided while being prevented from meandering transversely and in which rolling frictions are applied to the damblocks of the side dam so that the side dam and the corresponding dam side guide may be prevented from being scratched.

A further object of the present invention is to provide a twin-belt casting machine in which the outer and inner side of the damblocks of the side dam are guided so that the weight of the side dam may be effectively utilized.

According to a major feature of the present invention there is provided a loop type continuous metal casting machine comprising: upper and lower endless revolving casting belts; two side dams each including a multiplicity of metal damblocks and revolved in a loop, which passes along a casting zone from the entrance end thereof, between said revolving casting belts by the lower one of said revolving casting belts to define a downhill moving mold between said two side dams, said loop returning from the exit end to the entrance end of said casting zone along a path located away from said casting zone; and two flexible metal strap loops stringing said side dams therethrough, respectively, to form a pair of side dam loops each having said metal damblocks abutting in end-to-end relationship against one another but allowed to slide on and relative to the corresponding one of said metal strap loops, wherein the improvement comprises push means disposed near the entrance end of said casting zone and reciprocated back and forth in synchronism with the passage of each of said side dams for periodically entering the wedge-shaped gap, which is formed between the adjacent two of the metal damblocks of said corresponding side dam loop before entry into said casting zone, to push the preceding one of said adjacent two forward thereby to tightly press the preceding one of said metal damblocks together so that the end-to-end abutting relationships of said metal damblocks may be ensured while said side dam loops are passing through said casting zone, whereby molten metal can be continuously cast in said moving mold without burrs.

According to a second feature of the present invention, there is provided a loop type continuous metal casting machine, as set forth in the major feature, further comprising: meander preventing guide means for guiding said side dam loops passing while preventing the same from meandering transversely; and rolling friction means borne on side guide means for applying rolling frictions to the damblocks of said side dam loops.

According to a third feature of the present invention, there is provided a loop type continuous metal casting machine, as set forth in the second feature, further comprising: a cooling apparatus disposed near each of said side dam loops in said path downstream the exit end of said casting zone for cooling the corresponding side dam loop; and dam side bearing guide means mounted on said cooling apparatus for guiding the outer and inner sides of the damblocks of said corresponding side dam loop.

BRIEF DESCRIPTION OF THE DRAWINGS

Other objects, features and advantages of the present invention will become apparent from the following description taken in conjunction with the embodiments thereof with reference to the accompanying drawings, in which.

DESCRIPTION OF THE PREFERRED EMBODIMENTS

Figure 1:
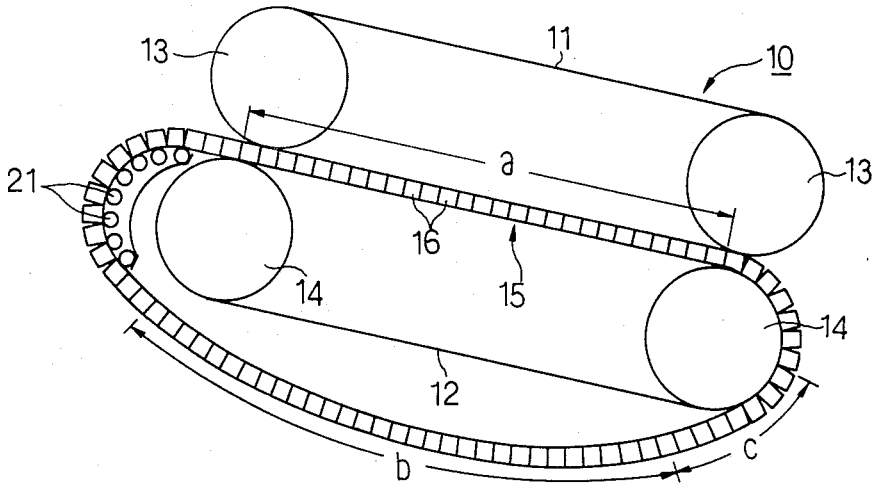
Fig. 1 PRIOR ART
FIG. 1 is a schematic side elevation showing the moving dam type continuous metal casting machine according to the prior art.
Figure 2:
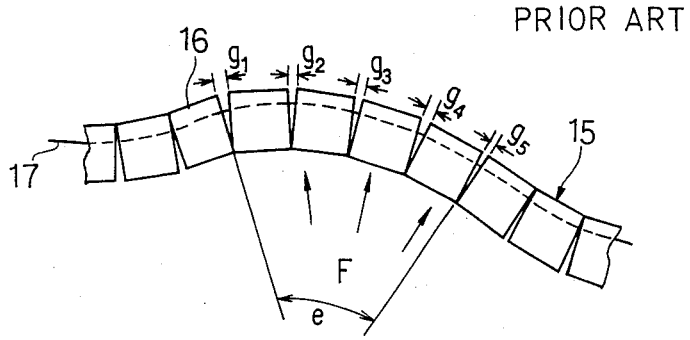
Fig. 2 PRIOR ART
FIG. 2 is an enlarged view showing a portion of the side dam of the metal casting machine of FIG. 1.

The present invention will be described in the following with reference to FIGS. 7 to 15, in which like reference numerals indicate like or corresponding components of the loop type continuous metal casting machine indicated generally at numeral 30. This metal casting machine 30 according to the present invention is constructed of the following major components for realizing the three concepts: (1) to eliminate the gaps of the damblocks in the casting zone by pushing them before they enter the casting zone; (2) to prevent the side dams from meandering by applying rolling frictions to the damblocks; and (3) to make effective use of the weights of the side dams by bearing and guiding the outer and inner sides of the damblocks of the side dams.

(1) The first concept is put into practice by providing a push apparatus which is indicated generally at numeral 40 and which will be described in detail with reference to FIGS. 7 and 11 to 15. As seen from FIG. 7 together with FIG. 1, the push apparatus 40 is disposed near or just upstream of the entrance end of the casting zone a and reciprocated back and forth in synchronism with the passage of each of the side dams 15 for periodically entering the wedge-shaped gap $\mathbf{16}_0$, which is formed between the adjacent two $\mathbf{16}_1$ and $\mathbf{16}_2$ of the metal damblocks 16 of the corresponding side dam loop before entry into the casting zone a, to push the preceding damblock $\mathbf{16}_1$ forward thereby to tightly press the preceding damblocks 16 together. As a result, the end-to-end abutting relationships of the metal dam-blocks 16 are ensured while the corresponding side dams 15 are passing through the casting zone a.

Figure 5:
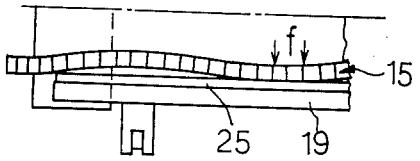
Fig.5 PRIOR ART
FIG. 5 is an enlarged top plan view showing a portion of the casting machine of FIG. 3 and the interactions among one of the side dams and the corresponding dam side guide and guide liner.
Figure 6:
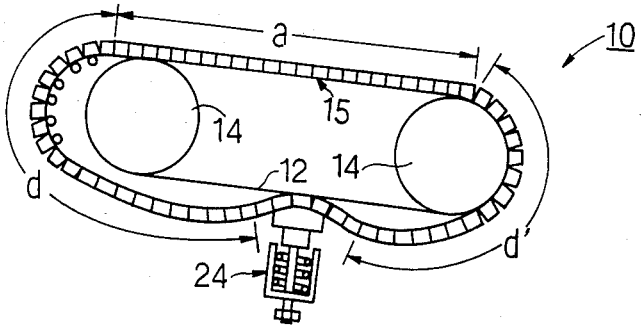
Fig.6 PRIOR ART
FIG. 6 is a simplified side elevation showing the moving dam type continuous metal casting machine of FIGS. 1 and 3, which is equipped with the tensioning apparatus.
Figure 7:
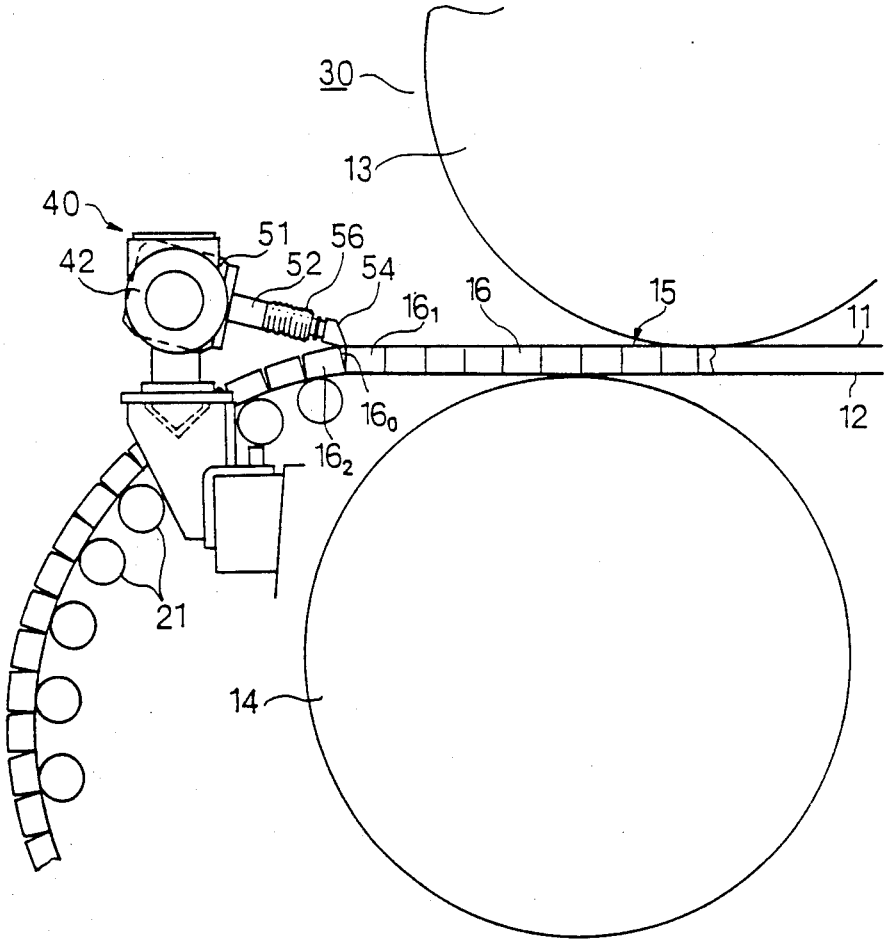
FIG. 7 is an enlarged side elevation showing a loop type continuous metal casting machine which is equipped with a push apparatus according to the present invention.
Figure 8:
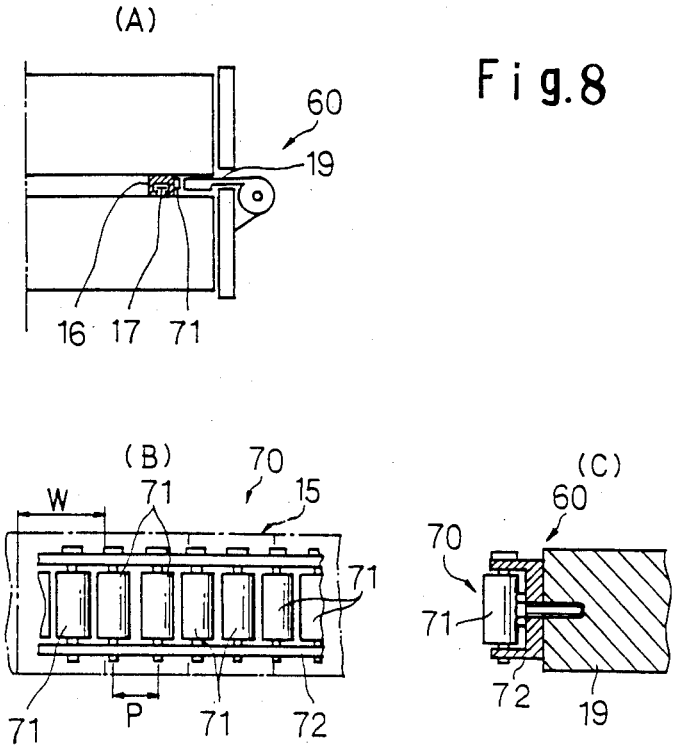
FIGS. 8(A), (B) and (C) are enlarged front elevation, side elevation and side section, respectively, showing a dam side guide which is equipped with rollers.

(2) The second concept is achieved by providing meander preventing guide means and rolling friction means which are indicated generally at 60 and 70, respectively, in FIGS. 8(A), (B) and (C). The former guide means 60 guides the side dams 15 by means of the dam side guides 19 while preventing the same from meandering transversely, and the latter means 70 applies rolling frictions to the damblocks 16 of the side dams 15 by means of rollers 71. In other words, the frictions between the dam side guides 19 and the traveling side dams 15 are changed from the sliding frictions by the guide liners 25 according to the prior art, as shown in FIG. 5, to the rolling frictions by the rollers 71 so that the scratches which are unavoidable in the prior art may be minimized.

Figure 3:
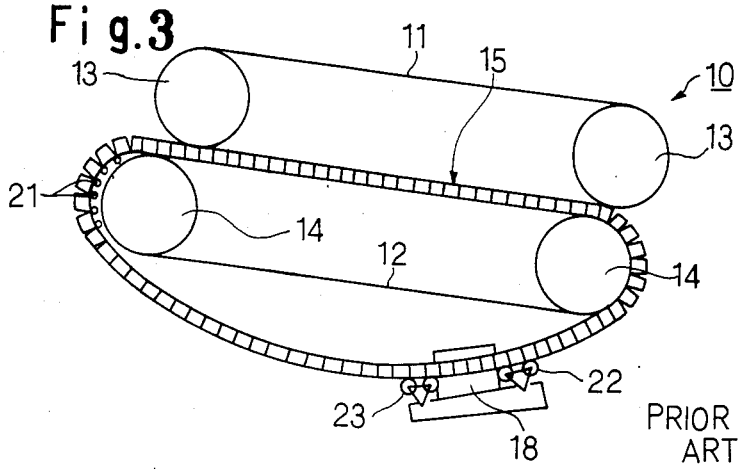
FIG. 3 is similar to FIG. 1 but shows the moving dam type continuous metal casting machine of the prior art, which is equipped with the cooling apparatus and the flanged rollers.
Figure 4:
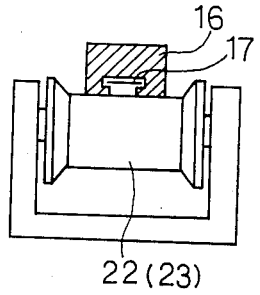
Fig.4 PRIOR ART
FIG. 4 is an enlarged front elevation showing a portion of the casting machine of FIG. 3 and the inside of the one of the damblocks, which is borne on one of the flanged rollers.
Figure 9:
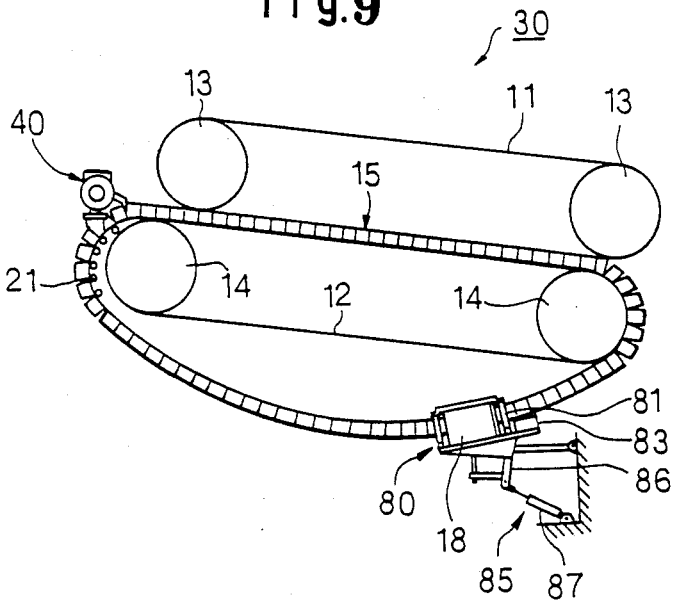
FIG. 9 is similar to FIGS. 1 and 3 but shows a loop type continuous metal casting machine which is equipped with the cooling apparatus and front and rear rollers as well as a dam drop sensor and cooling apparatus lifter according to the prevent invention.
Figure 10:
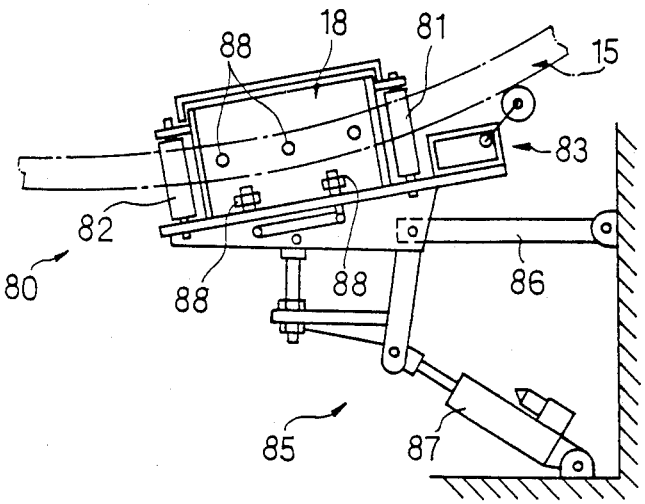
FIG. 10 is an enlarged side elevation showing the cooling apparatus, the front and rear rollers, the dam drop sensor and the dam guide lifter of FIG. 9.
Figure 11:
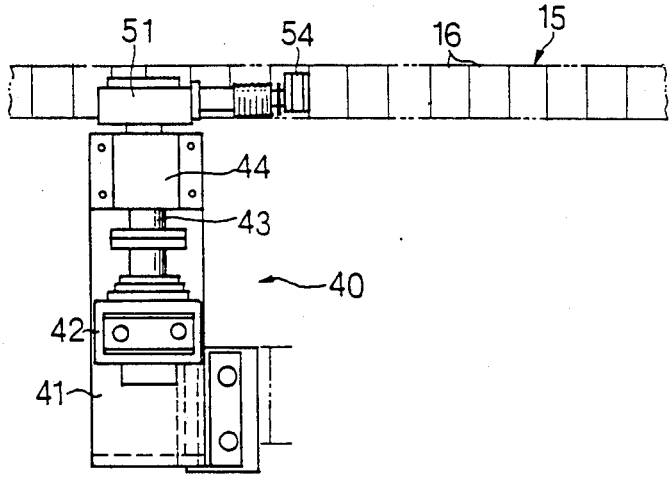
FIG. 11 is an enlarged top plan showing the push apparatus of FIG. 7.
Figure 12:
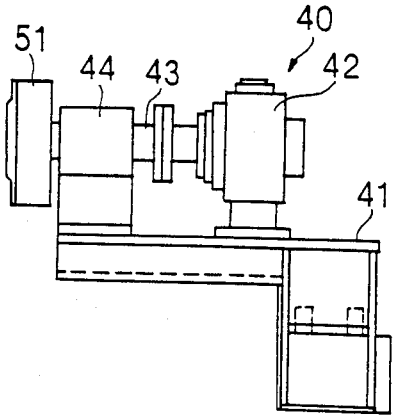
FIG. 12 is an enlarged front elevation showing the push apparatus of FIGS. 7 and 11.
Figure 13:
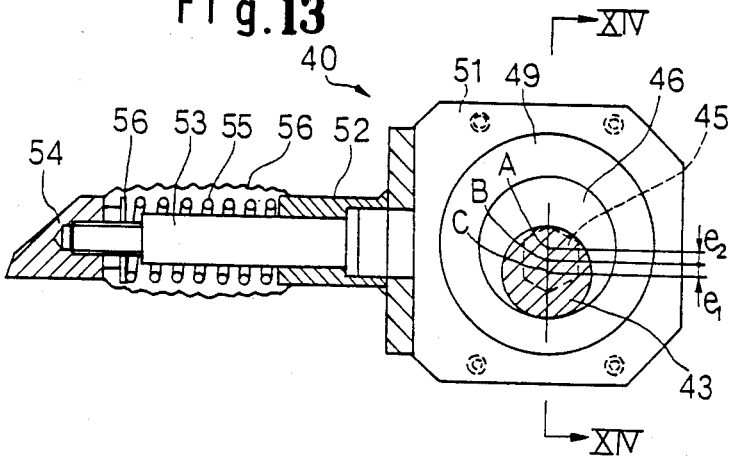
FIG. 13 is an enlarged partially sectional side elevation showing the push apparatus of FIGS. 7, 11 and 12.
Figure 14:
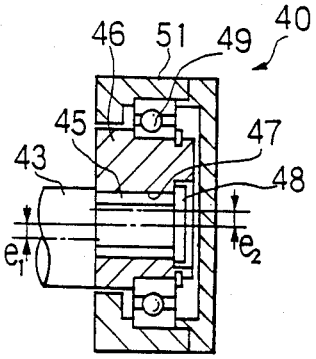
FIG. 14 is a section taken along line XIV—XIV of FIG. 13.

(3) The third concept is practised by attaching dam side bearing guide means, which is indicated generally at numeral 80 in FIGS. 9 and 10, to the cooling apparatus 18. The dam side guide means 80 guides the outer and inner sides of the damblocks 16 of the side dams 15 by means of front and rear rollers 81 and 82 which are borne rotatably on the cooling apparatus 18. The front and rear rollers 81 and 82 positioned generally perpendicularly to the side dams 15 for bearing and guiding the outer and inner sides of the damblocks 16. As a result, the side dams 15 are borne and guided to apply their effective weights to the lower casting belt 12 so that their revolutions are ensured. In other words, the horizontal flanged rollers 22 and 23 of the prior art, as shown in FIG. 3, for directly bearing the weights of the moving side dams 15 are replaced by the vertical rollers 81 and 82 which roll to guide the outer and inner sides of the damblocks 16. Thus, the weights of the side dams 15 can be utilized effectively.

Now, the push apparatus 40 according to the aforementioned first concept (1) will be described in more detail with reference to FIGS. 7 and 11 to 15. At the entrance end of the moving mold or the casting zone and outside of each side dam 15, there is disposed a bed 41 which is made integral with the frame of the continuous metal casting machine 30. On this bed 41, there is mounted an air motor 42 which has a spindle 43 extending in a plane normal to the casting zone or direction and borne rotatably by a bearing 44. From the inner end of the spindle 43, there extends an eccentric shaft 45 which has a polygonal, e.g., hexagonal section and which has an eccentricity $e_1$ with respect to the center of the spindle 43. On the eccentric shaft 45, there is fitted an eccentric cam 46 which has a fitting hole 47. For this fitting engagement, the fitting hole 47 has also a hexagonal section which is shaped and sized to fit the eccentric shaft 45 therein. This fitting hole 47 has an eccentricity $e_2$ with respect to the center of the eccentric cam 46. This cam 46 is prevented from coming out by means of a retainer 48 such as a snap ring which is fixed on the leading end of the eccentric shaft 45.

The eccentric shaft 46 has its center A located on the straight line, which extends from the center C of the spindle 43 via the center B of the eccentric shaft 45 fitted concentrically in the fitting hole 47 of the eccentric cam 46, so that its eccentricity $e_t$ is expressed by the following summation:

$$e_t=(\overline{AB}+\overline{BC})=e_1+e_2.$$

The eccentric cam 17 is borne rotatably through a bearing 49 in a bearing box 51 which is located just above each side dam 15. From the side of the bearing box 51 oriented toward the casting direction, there extends a guide sleeve 52 in which one end of a shaft 53 is slidably fitted. A push head 54 is screwed into the other or leading end of the shaft 53 and is biased away from the guide sleeve 52 toward the side dam 15 by the action of a coil spring 55 which is sandwiched between a spring retainer 56 fixed on the leading end of the shaft 53 and the extending end of the guide sleeve 52. Thus, the push apparatus 40 is placed above the side dam 15 while being subjected to such a rotational force around the eccentric cam 46 as is generated by the weights of the push head 54, the guide sleeve 52, the shaft 53, the coil spring 55 and so on. The push head 54 is made to have such a wedge-shaped snout as is facilitated to enter the wedge-shaped gap $16_0$ between the adjacent two metal damblocks $16_1$ and $16_2$ and to abut against the preceding damblock $16_1$. Indicated at numeral 56, incidentally, is a dust cover which is provided to cover the exposed extending portion of the shaft 53, the spring retainer 56 and the coil spring 55 thereby to clear them of any dust.

The eccentric cam 46 is connected with the eccentricity $e_t$ to the spindle 43 through the eccentric shaft 45, and the push head 54 is connected to that eccentric cam 46 through the bearing box 51 and so on. As a result, when the spindle 43 is driven by the air motor 42, the bearing box 51 is moved reciprocally to cause its center to draw a circle having a radius $e_t$ around the center C of the spindle 43. By these motions, the push head 54 is reciprocally moved back and forth with a stroke $2e_t$ above the side dam 15. Here, if the gap $16_0$ between the damblocks 16 of the side dam 15 assumed to consider the difference in the thermal expansions between the damblocks 16 and the steel strap loop 17 is designated at $g_o$, if the passing or traveling speed per a minute of the damblocks 16 of the side dam 15 is designated at $v_c'$ and if the number of revolutions per a minute of the spindle 43 is designated at N, it will be apparent that the following two equations have to be satisfied for eliminating the spaces of the gap $g_o$ between the damblocks 16 by pushing the damblocks 16 through the actions of the push head 54;

$$g_o/v_c>2/N \quad (1):$$

and $$g_o\leqq 2e_t \quad (2).$$

From these equations (1) and (2), the following equation holds:

$$N>v_c/e_t.$$

Hence, if the motor revolution number N and the eccentricity $e_t$ are so determined for the traveling speed $v_c$ of the side dam 15 as to satisfy the above equation (3), the tip of the push head 54 enters the gap $16_0$ between the damblocks 16 of the side dam 15 to press them together toward the casting zone. Thus, the gap $16_0$ between the damblocks 16 to be pressed can be eliminated even if it takes the maximum $g_o$. Without any gap, on the other hand, the stroke $2e_t$ is absorbed by the compression of the coil spring 55 so that no excessive load is applied to the air motor 42.

Incidentally, in case various kinds of metal are to be cast by one loop type continuous metal casting machine, the gap between the damblocks of the side dam is changed in accordance with the metal kind selected. This change in the gap can be satisfactorily coped with by changing the push stroke $2e_t$, i.e., the sumed eccentricity $e_t$.

Figure 15:
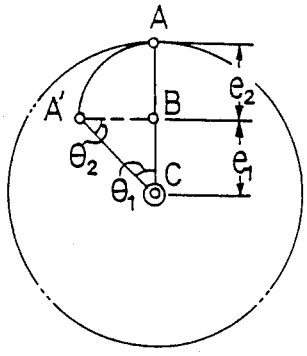
FIG. 15 is a diagram for explaining a function to adjust the eccentricity of the push apparatus of FIGS. 7 and 11 to 14.

This eccentricity $e_t$ can be adjusted by changing the angle which is contained between the segment $\overline{AB}$ and the segment $\overline{BC}$ in the fitting construction of the eccentric shaft 45 and the fitting hole 47 of the eccentric cam 46, as shown in FIG. 15. If the center or point A is shifted to a point A' by changing that construction, more specifically, the summed eccentricity $e_t$ is expressed by the length of the segment $\overline{CA'}$ and is determined by the following method:

If the angles of the segment $\overline{CA'}$ with respect to the segments $\overline{BC}$ and $\overline{A'B}$ are designated at $\theta_1$ and $\theta_2$, respectively, the segment $\overline{CA'}$ is expressed by the following equation:

$$\overline{CA'}=\overline{BC}.\cos\theta_1+\overline{A'B}.\cos\theta_2.$$

Here, $\overline{BC}=e_1$ and $\overline{A'B}=\overline{AB}=e_2$, and the eccentricity $e_t$ is rewritten, as follows:

$$e_t=e_1.\cos\theta_1+e_2.\cos\theta_2.$$

Since, in this case, the eccentric shaft 45 has a hexagonal section and the fitting hole 47 of the eccentric cam 46 also has a slightly larger hexagonal section, the eccentricity $e_t$ can be adjusted at four steps by changing the angle $(\theta_1+\theta_2)$ of the segment $\overline{AB}$ with respect to the segment $\overline{BC}$ to 0°, 60°, 120° and 180°.

In the push apparatus 40 thus far described according to the present embodiment, the reciprocations of the push head 54 are effected by means of the push apparatus 40, i.e., the rotation-straight motion transforming mechanism. However, this mechanism can be replaced by a straight motion mechanism such as an air cylinder.

Next, the meander preventing guide means 60 and the rolling friction means 70 according to the aforementioned first concept (2) will be described in more detail with reference to FIGS. 8(A), (B) and (C). The meander preventing guide means 70 is constructed of the paired dam side guides 19 each of which extends at least in the casting zone generally along the outer side of the corresponding side dam 15. On the inner side of each dam side guide 19, there is fixed a roller bearing member 72 which is provided for bearing the rollers 71 exemplifying the rolling friction means 70. These rollers 71 are arranged side-by-side in series and are borne rotatably on the roller bearing member 72. The outer circumferences of the rollers 71 are in rolling contact with the outer sides of the damblocks 16 of the side dam 15 so that they regulate the transverse positions of the damblocks 16. More specifically, the roller bearing member 72 is anchored at the inner side of the dam side guide 19 and has such a generally C-shaped section as to hinge the rollers 71, as better seen in FIGS. 8(B) and (C).

On the other hand, the positions and intervals of the rollers 71 hinged rotatably on the C-shaped extending ends of the roller bearing member 72 are not limited in the least. According to the experiments, it has been found that the interval P of the rollers 71 smoothens the travel of the side dam 15 if it suffices the following relationship for the length W of one damblock 16:

$$W\geqq 2P.$$

It has also been found that a better result can be attained if the rollers 71 are arranged over all the casting zone from the entrance end to the exit end thereof.

Incidentally, the means for bearing the rollers 71 on the inner side of the dam side guide 19 is not limited to the roller bearing member 72 which has the C-shaped section, but the roller bearing member 72 can be replaced by a roller chain, for example, which is attached to the inner side of the dam side guide 19. In this case, however, if the rollers 71 fail to have their axes extending in a common plane, i.e., have indentations with respect to the plane, the irregular contacting portions of the respective rollers 71 and the traveling side dam 15 are accompanied by the travels of the damblocks 16. Then, the indentations of the respective rollers 71 should be as small as possible (e.g., within ±0.2 mm).

Finally, the dam side bearing guide means 80 according to the third concept (3) will be described in the following with reference to FIGS. 9 and 10. As has been touched hereinbefore, the dam side bearing guide means 80 is mounted on the cooling apparatus 18 for guiding the outer and inner sides of the damblocks 16 of each side dam loop 15. Moreover, the cooling apparatus 18 is disposed, as customary, near the side dam 15 but downstream of the exit end of the casting zone, i.e., downstream of the righthand roll 14 of the lower belt 12, as seen in FIG. 9. Each guide means 80 is constructed of the paired front and rear rollers 81 and 82 which are borne rotatably on the front or upstream and rear or downstream ends of the cooling apparatus 18 and are held in vertical positions or in positions generally perpendicular to the side dam 15 so as to bear and guide the outer and inner sides of the damblocks 16. As a result, the side dam 15 is borne and guided to apply its effective weight to the lower casting belt 12, as better seen from FIG. 9, so that its revolution can be ensured.

Slightly upstream of the front roller 81 there is located a dam drop sensor 83 which is provided for sensing the drop, it any, of the side dam 15. This drop is usually caused by the thermal expansion of the side dam 15 itself. The sensor 83 may be exemplified by a known detector such as a limit switch. However, this limit switch may be replaced by a differential transformer, if the latter has excellent resposiveness. The dam guide lifter or dam guide dropping means 85 is also provided for controlling the cooling apparatus 18 to guide the outer and inner sides of the damblocks 16 of the side dam 15 with the front and rear rollers 81 and 82 in response to the drop of the side dam 15 sensed by the sensor 83. The dam guide lifter 85 responds to the drop of the side dam 15 to a position in which the side dam 15 can be borne and guided by the front and rear rollers 81 and 82 properly for applying its effective weight to the lower casting belt 12. As better seen from FIG. 10, the dam guide lifter 85 may be a known mechanism which is constructed of a link mechanism 86 and a hydraulic cylinder apparatus 87. As shown, the link mechanism 86 is connected between the cooling apparatus 18 and the frame of the continuous metal casting machine 30, and the hydraulic cylinder apparatus 87 is also connected between the machine frame and the link mechanism 86 to drop the cooling apparatus 18 through the link mechanism 86 to the above-specified position in response to the drop of the side dam 15 sensed by the dam drop sensor 83. While the drop of the side dam 15 is being sensed by the sensor 83, more specifically, the cylinder apparatus 87 is actuated to drop the front and rear rollers 81 and 82 through the cooling apparatus 18 and the link mechanism 86 so that the rollers 81 and 82 may come in the positions to guide the side dam 15.

Incidentally, the cooling apparatus 18 is equipped, as customary, with a set of spray nozzles 88 for spraying a liquid coolant such as water onto the hot damblocks 16 of the side dam 15. Here, if the front and rear rollers 81 and 82 are made sufficiently long, the sensor 83, the cylinder apparatus 87 and the link mechanism 86 may be dispensed with. In this case, however, the injection angles of the water jets from the spray nozzles 88 have to be sufficiently large for covering all the damblocks 16 passing through the cooling apparatus 18, because the relative positions of the spray nozzles 88 to the side dam 15 are varied.

As has been described hereinbefore, according to the first concept of the present invention, the push apparatus for pushing the damblocks toward the casting zone is disposed near or just upstream of the entrance end of the casting zone. As a result, the damblocks of the side dams can be freed from any gap inbetween while they are traveling in the casting zone. Thus, it is possible to solve the problems, which might otherwise be caused as a result of the steal of the molten metal into the interblock gaps, namely, to clear the cast product of burrs and to prevent the steel strap loops stringing the slotted damblocks from being damaged or broken. Even without any gap between the damblocks to be pressed, no excessive load is applied to the push apparatus thanks to the provision of the shock absorbing means so that the damblock pushing function of the push apparatus can be ensured. As a result, it is possible to stabilize the casting operations thereby to improve the quality of the cast product while saving the labor necessary.

According to the second concept of the present invention, moreover, the frictions between the dam side guides and the traveling side dams are effected by the rolling frictions. The side dams are prevented from meandering, while passing through the casting zone, to form no gap between their damblocks so that the molten metal can be prevented from stealing thereinto. At the same time, it is possible to prevent the side dams and their side guides from being scratched and stuck.

According to the third concept of the present invention, still moreover, the traveling side dams are borne by having their outer and inner sides guided by the rollers. This makes it possible to make effective use of the weights of the side dams borne on the lower casting belt so that the revolutions of the side dams can be ensured.

Thus, it will be understood from the detailed description thus far made that the present invention can have high effects in improving both the quality of the cast product and the rate of the casting operations.

What is claimed is:

1. A loop type continuous metal casting machine comprising:

upper and lower endless revolving casting belts;

two side dams each including a multiplicity of metal damblocks and revolved in a loop, which passes along a casting zone from the entrance end thereof, between said revolving casting belts by the lower one of said revolving casting belts to define a downhill moving mold between said two side dams, said loop returnig from the exit end to the entrance end of said casting zone along a path located away from said casting zone; and two flexible metal strap loops stringing said side dams therethrough, respectively, to form a pair of side dam loops each having said metal damblocks abutting in end-to-end relationship against one another but allowed to slide on and relative to the corresponding one of said metal strap loops, wherein the improvement comprises push means, said push means including a push head having a wedge-shaped snout, and actuating means for reciprocating the push head back and forth so that the push head enters periodically a wedge-shaped gap, which is formed between the adjacent two of the metal damblocks of said corresponding side dam loop before entry into said casting zone, to push the preceding one of said adjacent two forward thereby to tightly press the preceding one of said metal damblocks together so that the end-to-end abutting relationships of said metal damblocks may be ensured while said side dam loops are passing through said casting zone, whereby the molten metal can be continuously cast in said moving mold without burrs.

2. A loop type continuous metal casting machine according to claim 1, wherein said push means further includes:

shock absorbing means associated with said actuating means for biasing said push head toward said wedge-shaped gap to absorb the shock which is applied to said push rod when the latter enters said wedge-shaped gap.

3. A loop type continuous metal casting machine according to claim 2, wherein said actuating means includes:

a spindle made rotatable in a plane normal to said casting zone;

a prime mover for rotating said spindle;

an eccentric shaft having a polygonal section and extending with an eccentricity with respect to the center of said spindle from said spindle toward the corresponding one of said side dams;

an eccentric cam having a fitting hole, which has a polygonal section shaped and sized to fit said eccentric shaft therein and which has an eccentricity with respect to the center of said eccentric cam, and fitted on said eccentric shaft through said fitting hole;

a bearing box disposed just above said corresponding dam block; and bearing means fitting in said bearing box for bearing said eccentric shaft in a rotatable manner, and wherein said shock absorbing means includes:

a guide sleeve extending from said bearing box toward said corresponding side dam;

a shaft having its one end fitted slidably in said guide sleeve and its other extending toward said corresponding side dam and carrying said push head at its extending end;

a spring retainer carried on the extending end of said shaft just behind said push head; and a coil spring sandwiched under compression between said spring retainer and the extending end of said guide sleeve for biasing said push head away from said guide sleeve, whereby said bearing box is revolved around the center of said spindle on a circle having a radius equal to the sum of the eccentricities of said eccentric shaft and said eccentric cam so that said bush head is brought back and forth with a stroke twice as large as said sum above said corresponding side dam.

4. A loop type continuous metal casting machine according to claim 3, wherein said actuating means further includes a cam retainer fixed on the leading end of said eccentric shaft for retaining said eccentric shaft to prevent the same from coming out, and wherein said shock absorbing means further includes a dust cover covering the exposed extending portion of said shaft, said spring retainer and said coil spring for clearing the same of any dust.

5. A loop type continuous metal casting machine according to claim 3, wherein said eccentric shaft has a hexagonal section, whereby the summed eccentricity can be adjusted at four steps by changing an angle, defined between the line joining the centers of said eccentric shaft and said eccentric cam and the line joining the centers of said spindle and said eccentric shaft, to 0°, 60°, 120° and 180°.

6. A loop type continuous metal casting machine according to claim 3, wherein said prime mover has the number of revolutions N satisfying the following relationship:

$$N > v_c/e_t,$$

wherein: $v_c$ designates the passing speed of the damblocks of said corresponding side dam; and $e_t$ designates said summed eccentricity.

7. A loop type continuous metal casting machine according to claim 2, wherein said push means further includes:

a bed made integral with the frame of said continuous metal casting machine and disposed at the entrance end of said casting zone and outside of said corresponding side dam for installing said actuating means thereon; and bearing means installed on said bed for bearing the spindle of said actuating means.

8. A loop type continuous metal casting machine according to claim 1, further comprising:

meander preventing guide means for guiding said side dam loops passing while preventing the same from meandering transversely; and rolling friction means borne on said guide means for applying rolling frictions to the damblocks of said side dam loops.

9. A loop type continuous metal casting machine according to claim 8, wherein said meander preventing guide means includes: a pair of dam side guides each extending partially between the upper and lower endless revolving belts and generally along the outer side of the corresponding one of said side dam loops; and roller bearing means fixed on the inner side of the corresponding one of said dam side guides for bearing said rolling friction means, and wherein said rolling friction means includes a multiplicity of rollers borne rotatably on said roller bearing means and having their circumferences contacting with the outer sides of the damblocks of the corresponding dam side loop for rolling thereon to regulate the transverse positions of the same damblocks.

10. A loop type continuous metal casting machine according to claim 9, wherein said rollers are juxtaposed in series to one another to have an interval P satisfying the following relationship to the length W of one of said damblocks:

$$W \geqq 2P.$$

11. A loop type continuous metal casting machine according to claim 9, wherein said roller bearing means includes a pair of roller bearing members each anchored at the inner side of said corresponding dam side guide and having such a C-shaped section as to hinge said rollers at a suitable interval to its extending ends.

12. A loop type continuous metal casting machine according to claim 1, further comprising:

a cooling apparatus disposed near each of said side dam loops in said path downstream the exit end of said casting zone for cooling the corresponding side dam loop; and dam side bearing guide means mounted on said cooling apparatus for guiding the outer and inner sides of the damblocks of said corresponding side dam loop.

13. A loop type continuous metal casting machine according to claim 12, wherein said dam side bearing guide means each includes a pair of front and rear rollers borne rotatably on said cooling apparatus and positioned generally perpendicularly to said path for bearing and guiding the outer and inner sides of said damblocks so that said corresponding side dam loop may be borne and guided to apply its effective weight to said lower revolving casting belt thereby to ensure its revolution.

14. A loop type continuous metal casting machine according to claim 12, further comprising:

dam drop sensing means disposed near said path slightly upstream of said dam side bearing guide means for sensing the drop, if any, of each of said side dam loops; and a cooling apparatus lifting means made responsive to the drop or rise of said side dam loop sensed by said sensing means for dropping or lifting said side dam loop to a position in which the same side dam loop can be borne and guided by said guide means properly for the application of its effective weight.

15. A loop type continuous metal casting machine according to claim 14, wherein said cooling apparatus lifting means includes: a link mechanism connected between said cooling apparatus and the frame of said continuous metal casting machine; and a hydraulic cylinder apparatus connected between said frame and said line mechanism and responding to said sensing means for dropping or lifting said side dam loop through said link mechanism to said position.

16. A loop type continuous metal casting machine according to claim 14, wherein said sensing means is a limit switch.

17. A loop type continuous metal casting machine according to claim 14, wherein said sensing means is a differential transformer.

* * * * *